US012808588B2

(12) United States Patent
Yamasuso

(10) Patent No.: US 12,808,588 B2
(45) Date of Patent: Nov. 24, 2026

(54) OUTDOOR UNIT AND REFRIGERATION CYCLE DEVICE

(71) Applicant: Mitsubishi Electric Corporation, Tokyo (JP)

(72) Inventor: Masaya Yamasuso, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 110 days.

(21) Appl. No.: 18/868,390

(22) PCT Filed: Sep. 8, 2022

(86) PCT No.: PCT/JP2022/033634
§ 371 (c)(1),
(2) Date: Nov. 22, 2024

(87) PCT Pub. No.: WO2024/053034
PCT Pub. Date: Mar. 14, 2024

(65) Prior Publication Data
US 2026/0185753 A1 Jul. 2, 2026

(51) Int. Cl.
*F25B 43/00* (2006.01)
*F25B 41/40* (2021.01)
*F25B 49/00* (2006.01)

(52) U.S. Cl.
CPC ..... *F25B 43/006* (2013.01); *F25B 41/40* (2021.01); *F25B 49/005* (2013.01)

(58) Field of Classification Search
CPC ..... F25B 43/006; F25B 41/40; F25B 49/005
See application file for complete search history.

(56) References Cited

U.S. PATENT DOCUMENTS 3,754,409 A * 8/1973 Wreen, Jr. ..... F25B 43/006 62/505
2015/0300701 A1 10/2015 Nakaguchi et al.

FOREIGN PATENT DOCUMENTS

| | | | |
|---|---|---|---|
| CN | 104930655 A | | 9/2015 |
| JP | 63-069966 U | | 5/1988 |
| JP | S6423073 A | * | 1/1989 |
| JP | 2002-115940 A | | 4/2002 |
| JP | 2010-084965 A | | 4/2010 |
| JP | 2010-281463 A | | 12/2010 |
| JP | 2015-206553 A | | 11/2015 |

OTHER PUBLICATIONS

Liu et al., Fusible Plug Structure . . . , Sep. 23, 2015, CN104930655A, Whole Document (Year: 2015).*
Imanishi et al., Refrigerating Equipment, Jan. 25, 1989, JPS6423073A, Whole Document (Year: 1989).*
International Search Report of the International Searching Authority mailed Oct. 18, 2022 in corresponding International Patent Application No. PCT/JP2022/033634 (and English translation).

* cited by examiner

*Primary Examiner* — Larry L Furdge
(74) *Attorney, Agent, or Firm* — Posz Law Group, PLC

(57) ABSTRACT

An embodiment of an outdoor unit of a refrigeration cycle device includes a compressor, a pressure container that is connected to the compressor, a relief pipe that is connected to the pressure container, and a fusible plug that plugs an opening that is formed on the relief pipe. The relief pipe has a connector that is connected to the pressure container, and at least one bend that is formed on a portion that is located between the connector and the opening.

10 Claims, 11 Drawing Sheets

OUTDOOR UNIT AND REFRIGERATION CYCLE DEVICE

CROSS REFERENCE TO RELATED APPLICATION

This application is a U.S. national stage application of PCT/JP2022/033634 filed on Sep. 8, 2022, the contents of which are incorporated herein by reference.

TECHNICAL FIELD

The present disclosure relates to an outdoor unit and a refrigeration cycle device.

BACKGROUND ART

For example, as disclosed in Patent Document 1, a fusible plug that is installed on an accumulator (pressure container), which is provided on a cooling circuit having a refrigerant flow through, is known. Such a fusible plug melts when inner pressure of the accumulator abnormally increases. Therefore, the inner pressure of the accumulator is released.

CITATION LIST

Patent Documents

Patent Document 1: Japanese Unexamined Patent Application, First Publication No. 2002-115940

SUMMARY OF INVENTION

Problem to be Solved by the Invention

There are cases for example, where a refrigerant having a high pressure and high temperature flows to the inside of the accumulator, when the accumulator mounted on the refrigeration cycle device abnormally stops or the like. In such a case, there is a risk of the refrigerant having the high pressure and high temperature coming into contact with the fusible plug, causing the fusible plug to inadvertently melt. Therefore, there is a risk of the pressure of the inside of the accumulator being released, even in a state there is no need to release pressure from the inside of the accumulator.

The present disclosure is made with the above problem in mind, and an object is to provide an outdoor unit having a construction that suppresses a fusible plug from accidentally melting, and a refrigeration cycle device that includes such outdoor unit.

Means to Solve the Problem

An embodiment of an outdoor unit of a refrigeration cycle device includes a compressor, a pressure container that is connected to the compressor, a relief pipe that is connected to the pressure container, and a fusible plug that plugs an opening that is formed on the relief pipe. The relief pipe has a connector that is connected to the pressure container, and at least one bend that is formed on a portion that is located between the connector and the opening.

Effects of the Invention

According to the present disclosure, it is possible to suppress a fusible plug from accidentally melting, in an outdoor unit of a refrigeration cycle device.

DESCRIPTION OF EMBODIMENTS

Figure 1:
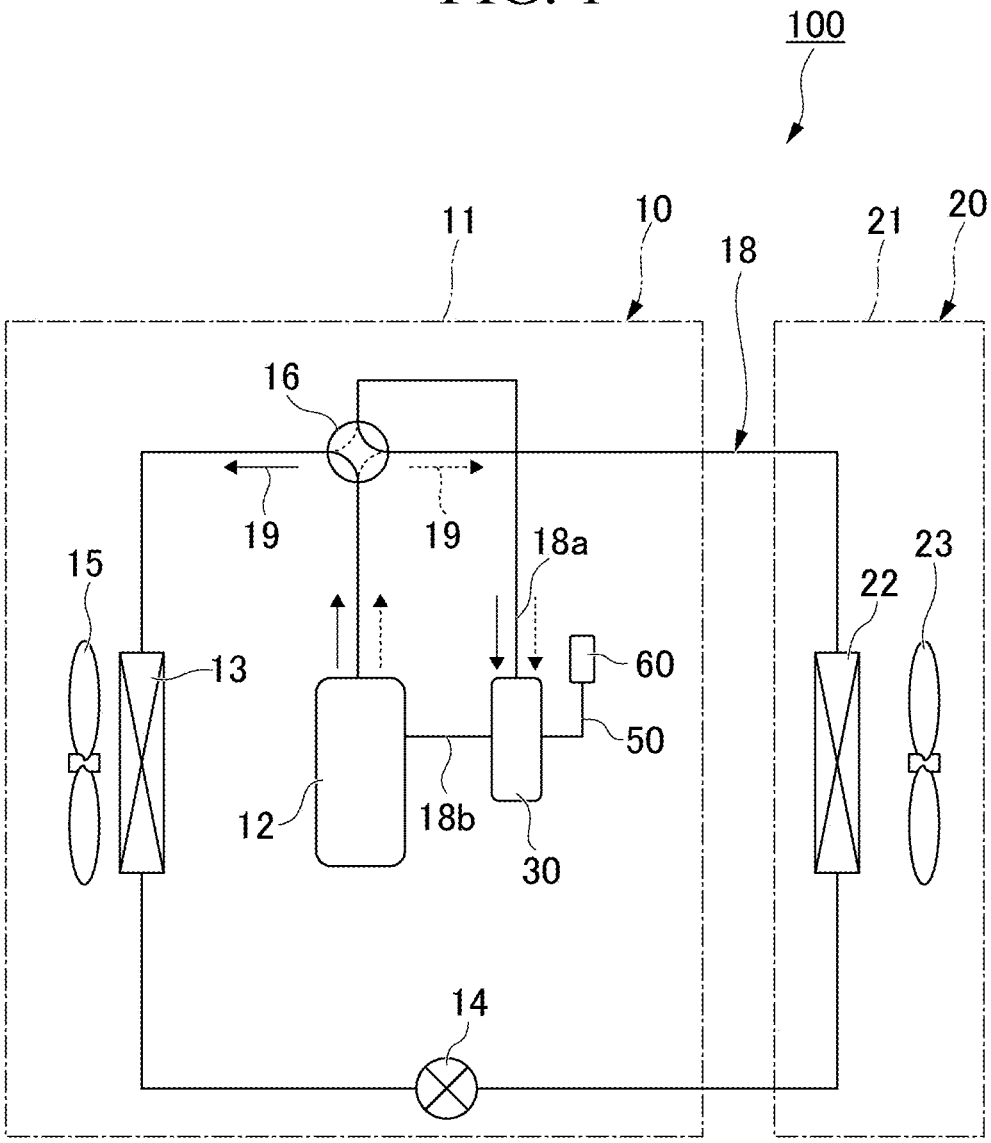
FIG. 1 A schematic diagram showing an outline of a refrigeration cycle device that includes an outdoor unit, according to an embodiment.

Hereinafter, embodiments of the present disclosure are explained with reference to the drawings. The scope of the present disclosure is not limited to the embodiments below, and embodiments may be changed so long as the embodiments do not depart from the technical scope of the present disclosure. In the drawings below, there are cases where scales and dimensions of various configurations may differ from actual scales and dimensions, to facilitate better understanding of the various embodiments.

The drawings show an X axis, a Y axis, and a Z axis where appropriate. The X axis shows a side out of sides of a horizontal direction. The Y axis shows another side out of sides of the horizontal direction. The Z axis shows a vertical direction. In the explanation below, a horizontal direction along the X axis is referred to as a "front-rear direction X", and a horizontal direction along the Y axis is referred to as a "left-right direction Y". A vertical direction along the Z axis is referred to as a "vertical direction Z". The front-rear direction X, the left-right direction Y, and the vertical direction Z are mutually orthogonal directions. In the explanation below, a side out of sides of the vertical direction Z in which the arrow of the Z axis faces is a "top side" (+Z side) in the vertical direction. The other side out of sides of the vertical direction Z which faces an opposite side the arrow of the Z axis faces is a "bottom side" (−Z side) in the vertical direction. In the explanation below, the top side in the vertical direction is simply referred to as "top side". The bottom side in the vertical direction is simply referred to as "bottom side". A top direction in the vertical direction is simply referred to as a "top direction". A bottom direction in the vertical direction is simply referred to as a "bottom direction".

A side out of sides in the front-rear direction X in which the arrow of the X axis faces is a "front side" (+X side). The other side out of sides of the front-rear direction X which faces an opposite side the arrow of the X axis faces is a "rear side" (−X side). The left-right direction Y is a left-right direction in a state where an outdoor unit 10 in the embodiments below is seen from the front (+X direction). In other words, a side out of sides of the left-right direction Y in which the arrow of the Y axis faces is a "right side" (+Y axis). Another side out of sides of the left-right direction Y which faces an opposite side the arrow of the Y axis faces is a "left side" (−Y side).

FIG. 1 is a schematic diagram showing an outline of a refrigeration cycle device 100 that includes an outdoor unit 10, according to an embodiment. The refrigeration cycle device 100 is a device that uses a refrigeration cycle, which circulates a refrigerant 19. The refrigeration cycle device 100 in the present embodiment is an air conditioner. As shown in FIG. 1, the refrigeration cycle device 100 includes the outdoor unit 10, an indoor unit 20, and a circulation path 18. The outdoor unit 10 is disposed outdoors. The indoor unit 20 is disposed indoors. The outdoor unit 10 and the indoor unit 20 are connected to one another using the circulation path 18, which circulates the refrigerant 19. The outdoor unit 10 and the indoor unit 20 are heat exchange units that conduct heat exchange with air.

By having the refrigerant 19 that flows within the circulation path 18 and the indoor unit 20 conduct heat exchange with the air indoors, it is possible for the refrigeration cycle device 100 to adjust a temperature of the air indoors. A refrigerant such as a fluorine based refrigerant with a low global warming potential (GWP: Global Warming Potential), or a hydrocarbon based refrigerant or the like may be mentioned as examples of the refrigerant 19.

The outdoor unit 10 includes a housing 11, a compressor 12, a heat exchanger 13, a flow adjustment valve 14, a blower 15, a four-way valve 16, a pressure container 30, a relief pipe 50, a fusible plug 60, and a controller that is not shown on the drawings. The compressor 12, the heat exchanger 13, the flow adjustment valve 14, the blower 15, the four-way valve 16, the pressure container 30, the relief pipe 50, the fusible plug 60, and the controller that is not shown on the drawings are housed on an inside of the housing 11. The controller that is not shown on the drawings in the outdoor unit 10, controls the outdoor unit 10. Said controller for example, is a control system that controls the entirety of the refrigeration cycle device 100.

The compressor 12, the heat exchanger 13, the flow adjustment valve 14, the four-way valve 16, and the pressure container 30 are provided on a part that is located on the inside of the housing 11, out of the circulation path 18. The compressor 12, the heat exchanger 13, the flow adjustment valve 14, the four-way valve 16, and the pressure container 30 are connected by the part that is located on the inside of the housing 11, out of the circulation path 18.

The four-way valve 16 is provided on a part that is connected to a discharge side of the compressor 12, out of the circulation path 18. By switching a portion of the circulation path 18, it is possible for the four-way valve 16 to reverse a direction of flow of the refrigerant 19 within the circulation path 18. In a state where the path connected by the four-way valve 16 is the path of the four-way valve 16 that is shown by solid lines in FIG. 1, the refrigerant 19 within the circulation path 18 flows in the direction shown by the solid line arrow in FIG. 1. On the other hand, in a state where the path connected by the four-way valve 16 is the path of the four-way valve 16 that is shown by dashed lines in FIG. 1, the refrigerant 19 flows within the circulation path 18 in the direction shown by the dashed line arrow in FIG. 1.

The indoor unit 20 includes a housing 21, a heat exchanger 22, and a blower 23. The housing 21 houses the heat exchanger 22, and the blower 23 on an inside thereof. It is possible for the indoor unit 20 to have a cooling operation where air inside the room the indoor unit 20 is disposed in is cooled, and to have a heating operation where the air inside the room the indoor unit 20 is disposed in is heated.

In a state where the indoor unit 20 is operated in the cooling operation, the refrigerant 19 that flows within the circulation path 18, flows in the direction shown by the solid lines in FIG. 1. In other words, in a state where the indoor unit 20 is operated in the cooling operation, the refrigerant 19 that flows within the circulation path 18 circulates so as to return to the compressor 12 after passing through the compressor 12, the heat exchanger 13 of the outdoor unit 10, the flow adjustment valve 14, the heat exchanger 22 of the indoor unit 20, and the pressure container 30, in such an order. During the cooling operation, the heat exchanger 13 on an inside of the outdoor unit 10 functions as a condenser, and the heat exchanger 22 on an inside of the indoor unit 20 functions as an evaporator.

On the other hand, in a state where the indoor unit 20 is operated in the heating operation, the refrigerant 19 that flows within the circulation path 18 flows in the direction shown by dashed lines in FIG. 1. In other words, in a state where the indoor unit 20 is operated in the heating operation, the refrigerant 19 that flows within the circulation path 18 circulates so as to return to the compressor 12 after passing through the compressor 12, the heat exchanger 22 of the indoor unit 20, the flow adjustment valve 14, the heat exchanger 13 of the outdoor unit 10, and the pressure container 30 in such an order. During the heating operation, the heat exchanger 13 on the inside of the outdoor unit 10 functions as the evaporator, and the heat exchanger 22 on the inside of the indoor unit 20 functions as the condenser.

Figure 2:
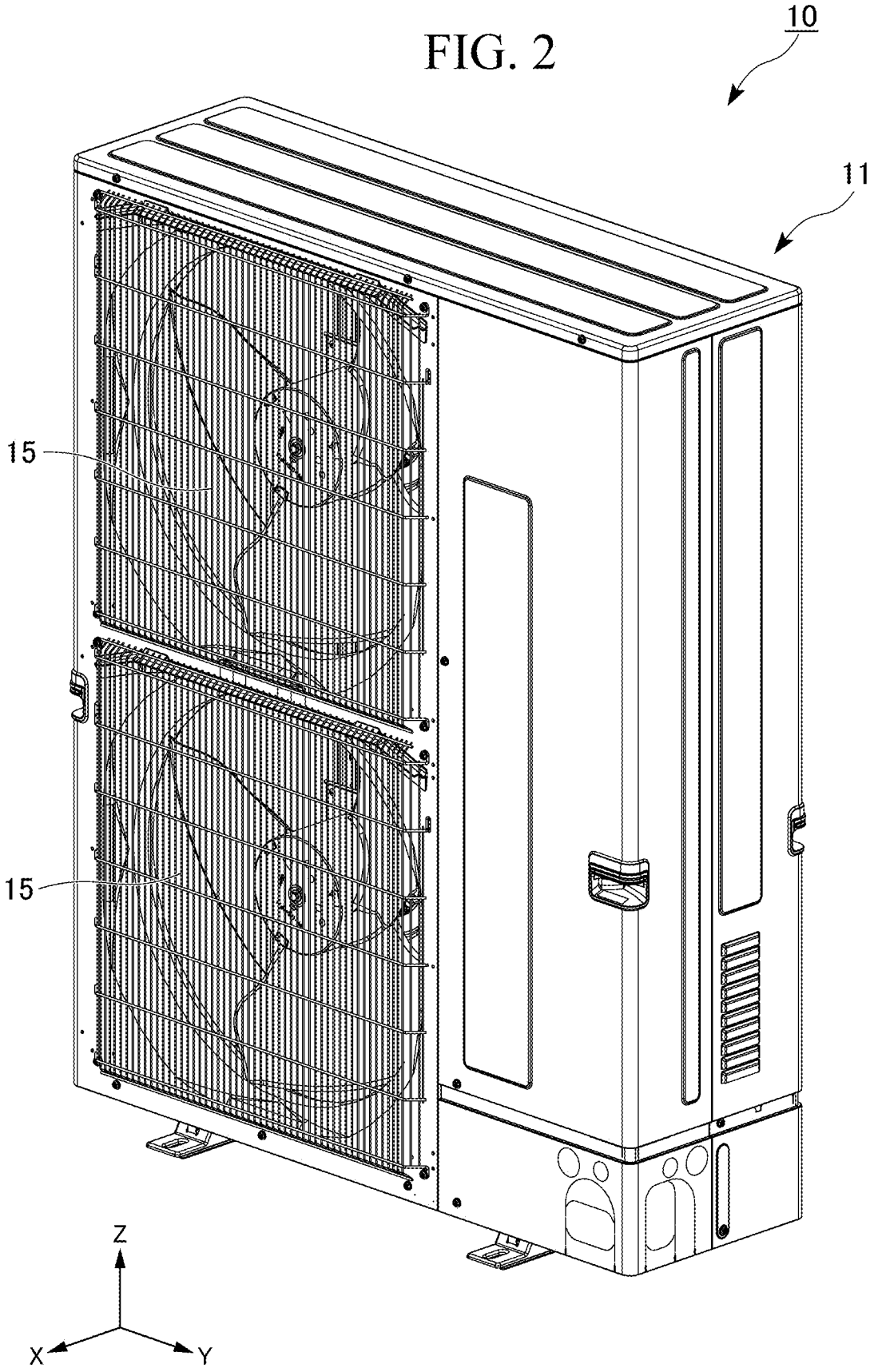
FIG. 2 A perspective view that shows the outdoor unit in the embodiment.
Figure 3:
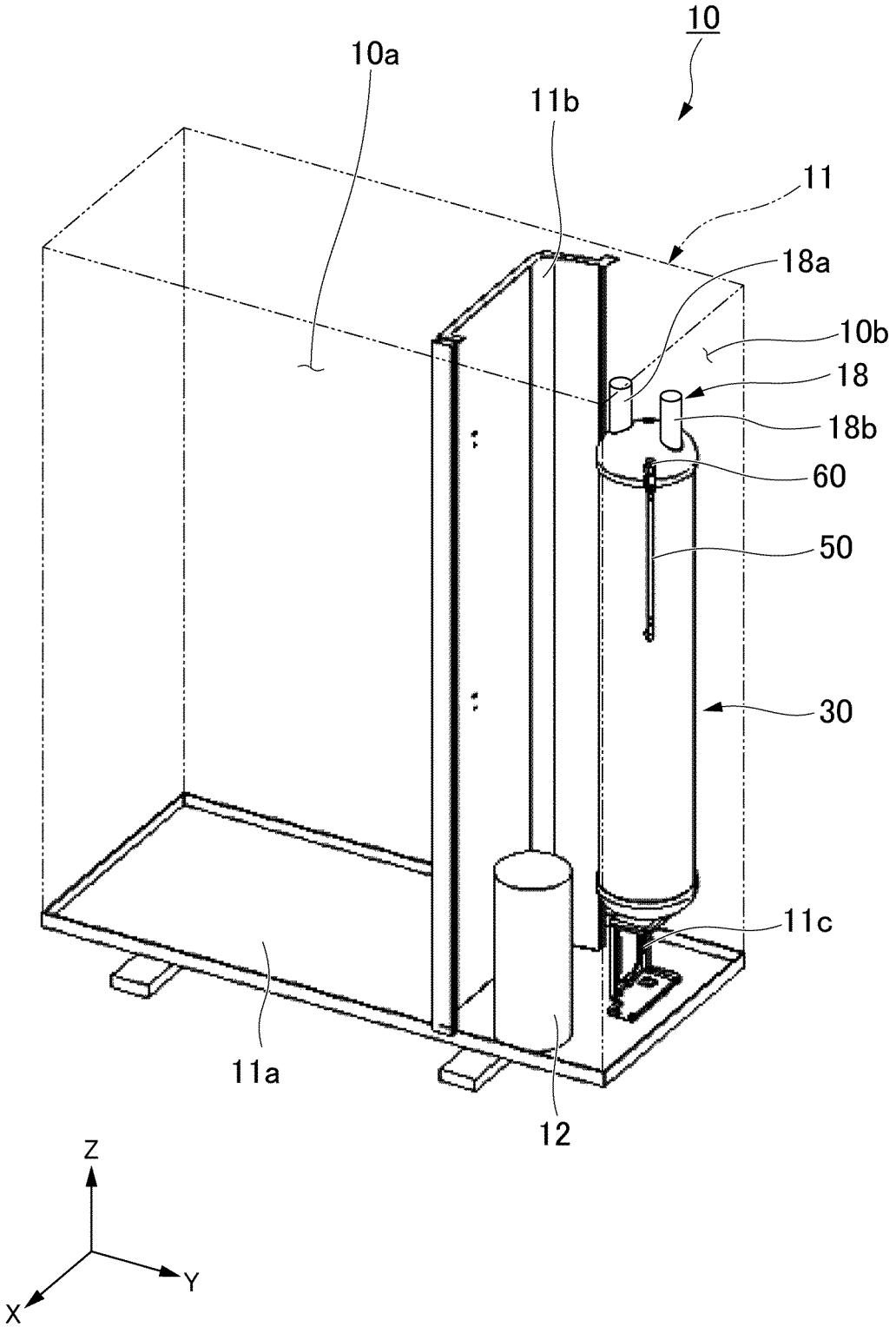
FIG. 3 A perspective view that shows a portion of the outdoor unit in the embodiment.

The indoor unit 10 of the present embodiment is explained in further detail. FIG. 2 is a perspective view that shows the outdoor unit 10. FIG. 3 is a perspective view that shows a portion of the outdoor unit 10. As shown in FIG. 2, the housing 11 is a semi-square box that has surfaces which face the front-rear direction X, the left-right direction Y, and the vertical direction Z. Two blowers 15 that align in the vertical direction Z are provided on the inside of the housing 11 in the present embodiment.

As shown in FIG. 3, the housing 11 has a blower room 10*a* and a mechanical room 10*b* that are partitioned from one another by a partition 11*b*. The blower room 10*a* and the mechanical room 10*b* are disposed next to one another in the left-right direction Y. A dimension of the blower room 10*a* in the left-right direction Y is larger than a dimension of the mechanical room 10*b* in the left-right direction Y. The blower room 10*a* is located on the left (−Y direction) of the mechanical room 10*b*. Although omitted from the drawings, the heat exchanger 13 and the blower 15 are disposed on an inside of the blower room 10*a*. The compressor 12, the pressure container 30, the relief pipe 50, and the fusible plug 60 are disposed on an inside of the mechanical room 10*b*. Although omitted from the drawings, the controller of the outdoor unit 10 that is not shown on the drawings is disposed on the inside of the mechanical room 10*b*. The compressor 12 is fixed to a top surface of a bottom 11*a* of the housing 11, on the inside of the mechanical room 10*b*. The compressor 12 is a semi-cylindrical shaft that extends in the vertical direction Z. The compressor 12 is located on a bottom end of a front side (+X side) out of the inside of the mechanical room 10*b*.

The pressure container 30 is fixed to a top surface of the bottom 11*a* via a support 11*c*, on the inside of the mechanical room 10*b*. The pressure container 30 is located above, apart from the top surface of the bottom 11*a*. The pressure container 30 is located on a portion on the right side (+Y side), out of the inside of the mechanical room 10*b*. The pressure container 30 is a cylindrical tube that extends in the vertical direction Z. An end on a bottom side of the pressure container 30 is located below, more than an end on a top side of the compressor 12. An end on a top side of the pressure container 30 is located above, more than the end on the top side of the compressor 12. The pressure container 30 is located to the rear (−X side) more than the compressor 12. The aforementioned relative locations of the compressor 12 and the pressure container 30 with respect to one another serves only as an example, and relative locations of the compressor 12 and the pressure container 30 are not particularly limited thereto.

Figure 4:
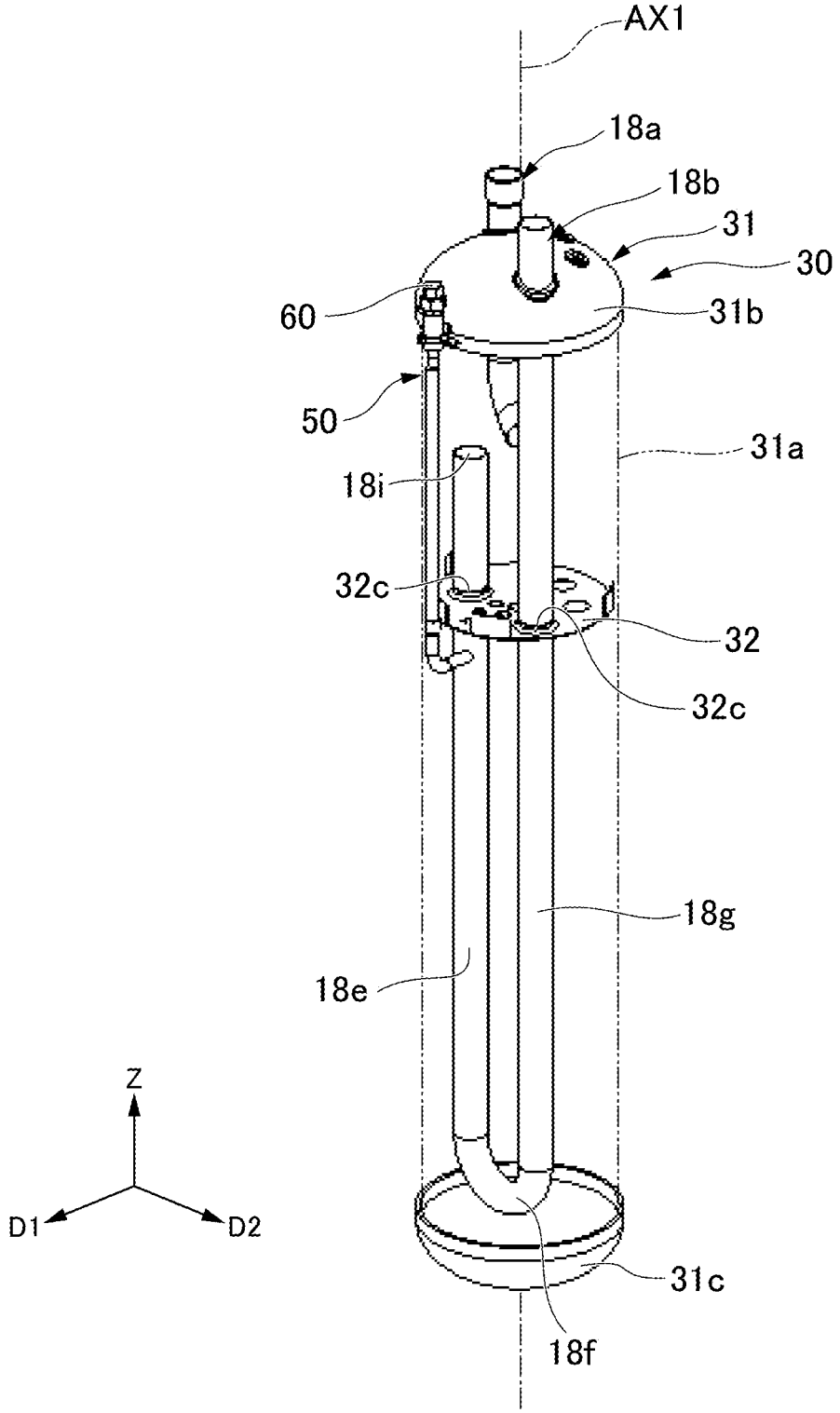
FIG. 4 A perspective view that shows a pressure container, a relief pipe, and a fusible plug in the embodiment.
Figure 5:
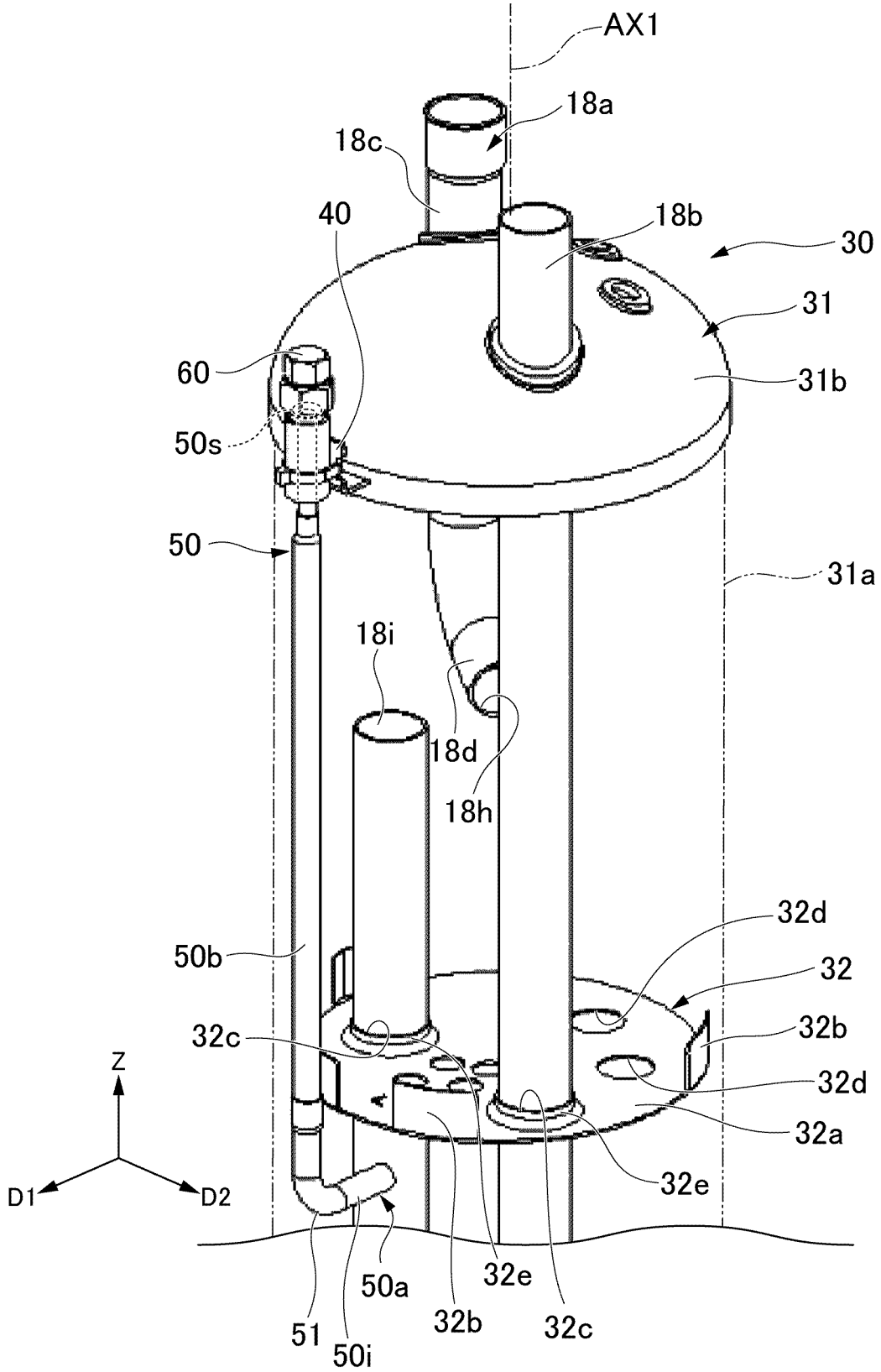
FIG. 5 A partial exploded view of the perspective view of FIG. 4 that shows a portion of the pressure container, the relief pipe, and the fusible plug in the embodiment.

FIG. 4 is a perspective view that shows the pressure container 30, the relief pipe 50, and the fusible plug 60. FIG. 5 is a partial exploded view of the perspective view of FIG. 4 that shows a portion of the pressure container 30, the relief pipe 50, and the fusible plug 60. It is possible to store excess refrigerant 19 on an inside of the pressure container 30. The refrigerant 19 in a liquid state is retained on the inside of the pressure container 30. In the present embodiment, the pressure container 30 is an accumulator. The pressure container 30 may be any container, so long as the container thereof is capable of retaining the excess refrigerant 19. As shown in FIG. 4, the pressure container 30 has a container 31, and a partition member 32.

The container 31 is a cylindrical tube that extends in the vertical direction Z. Hereinafter, an imaginary axis that passes through the center of the cylindrical tube container 31 is referred to as a "first center axis AX1". The first center axis AX1 is an imaginary center axis that extends in the vertical direction Z. In the explanation below, unless otherwise specified, a radial direction having a center thereof be the first center axis AX1 is simply referred to as a "radial direction". There are cases where a circumferential direction around the first center axis AX1 is simply referred to as a "circumferential direction". The radial direction having the first center axis AX1 be a center thereof is the radial direction of the pressure container 30, and is the radial direction of a tube member 31*a* to be mentioned later on.

The refrigerant 19 in a liquid state is stored on an inside of the container 31. The container 31 for example, is made of a metal. The inside of the container 31 is the inside of the pressure container 30. The container 31 has the tube member 31*a*, an upper lid member 31*b*, and a bottom lid member 31*c*.

The tube member 31*a* is a cylindrical tube that extends in the vertical direction Z having the first center axis AX1 as center thereof, and that opens to both sides in the vertical direction Z. The upper lid member 31*b* is a lid member that is attached to an end on the top side of the tube member 31*a*. The upper lid member 31*b* is a semi-hemispherical shell member that opens to the bottom. An end on the top side of the tube member 31*a* is fitted to an inside of an end on the bottom side of the upper lid member 31*b*. The upper lid member 31*b* blocks the opening on the top side of the tube member 31*a*. The bottom lid member 31*c* is a lid member that is attached to the end on the bottom side of the tube member 31*a*. The bottom lid member 31*c* is a semi-hemispherical shell member that opens to the top side. The end on the bottom side of the tube member 31*a* is fitted to an inside of the end on the top side of the bottom lid member 31*c*. The bottom lid member 31*c* blocks the opening on the bottom side of the tube member 31*a*.

Figure 6:
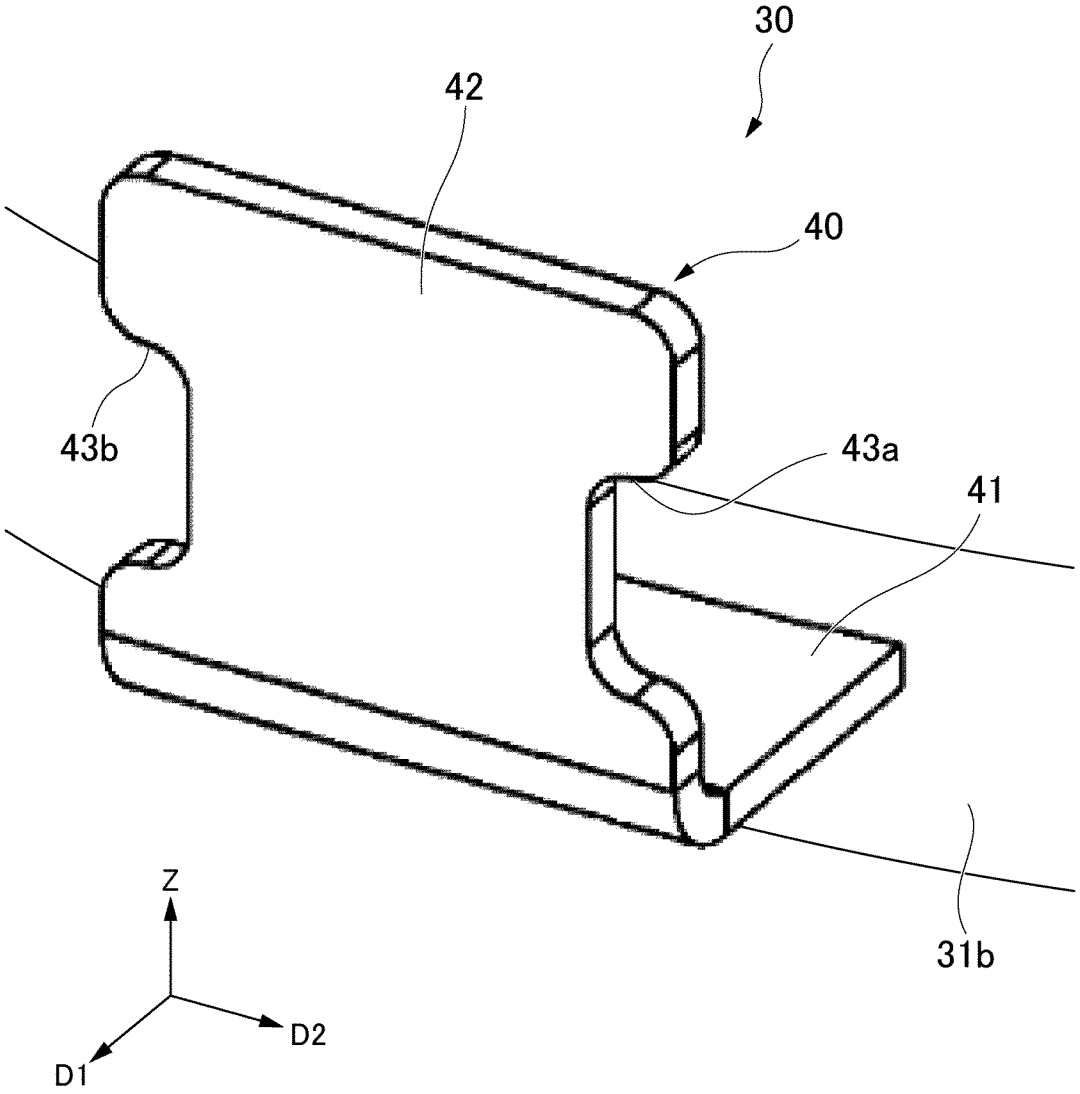
FIG. 6 A perspective view that shows a portion of an upper lid member, and an attachment member in the embodiment.

As shown in FIG. 5, an attachment member 40 is fixed to the upper lid member 31*b*. FIG. 6 is a perspective view that shows a portion of the upper lid member 31*b*, and the attachment member 40. As shown in FIG. 6, the attachment member 40 is a plate member having a bent shape. The attachment member 40 is for example, made of metal. The attachment member 40 has a base 41, and an attachment plate 42. The base 41 protrudes to the outside in the radial direction, from an outer circumferential surface on the bottom end of the upper lid member 31*b*. A plate surface of the base 41 is a plate that faces the vertical direction Z. An end on an inside of the radial direction of the base 41 extends in the circumferential direction, along the outer circumferential surface, on the bottom end of the upper lid member 31*b*. The end on the inside of the radial direction of the base 41 is fixed to the outer circumferential surface, on the bottom end of the upper lid member 31*b* for example, by welding. Accordingly, the attachment member 40 is fixed to the pressure container 30.

A radial direction out of radial directions having the first center axis AX1 as a center thereof, in which the base 41 protrudes, is referred to as a "first direction D1", and is shown as an axis "D1" on the drawings where appropriate. A direction orthogonal to both the vertical direction Z and the first direction D1 is referred to as a "second direction D2", and is shown as an axis D2 on the drawings where appropriate.

The attachment plate 42 protrudes above from an end on the outside in the radial direction of the base 41. A surface plate of the attachment plate 42 is a plate that faces the radial direction. One of a pair of recesses 43*a* and 43*b* is formed on each edge of the attachment plate 42 in the second direction D2. Each one of the pair of recesses 43*a* and 43*b* recesses towards the other one of the pair of recesses 43*a* and 43*b*, in the second direction D2. The pair of recesses 43*a* and 43*b* are formed in the center part in the vertical direction Z of the attachment plate 42.

As shown in FIG. 4, the partition member 32 is a partition member that partitions the container 31 in the vertical direction Z. A surface plate of the partition member 32 in the present embodiment is a baffle plate that faces the vertical direction Z. The partition member 32 is a cylindrical plate, with the first center axis AX1 as a center thereof. The partition member 32 in the present embodiment is disposed on a portion on the top side, out of an inside of the tube member 31*a*. The partition member 32 is located above, more than the center of the pressure container 30 in the vertical direction Z. The aforementioned position of the partition member 32 in the vertical direction Z on the inside of the container 31 is only one example, and the position of the partition member 32 in the vertical direction Z on the inside of the container 31 is not particularly limited thereto. As shown in FIG. 5, the partition member 32 has a circular plate 32*a*, which is a circular plate having the first center axis AX1 as a center thereof, and a fixing plate 32*b* that protrudes above from the outside edge in the radial direction of the circular plate 32*a*.

The circular plate 32*a* is fitted to the inside of the tube member 31*a*. Two pipe insertion holes 32*c* that penetrate the circular plate 32*a* in the vertical direction Z are formed on the circular plate 32*a*. The two pipe insertion holes 32*c* have a second pipe 18*b* to be mentioned later on, inserted through. Each of the pipe insertion holes 32*c* in the present invention is a circular hole. A burr 32*e* is formed up as a cylindrical tube that protrudes above, on each circumferential edge portion of each of the pipe insertion holes 32*c*, using burring.

A penetration hole 32*d* that penetrates the circular plate 32*a* in the vertical direction Z is formed on the circular plate 32*a*. In the present embodiment, the penetration hole 32*d* is a circular hole. A plurality of penetration holes 32*d* are formed. An inner diameter of the penetration hole 32*d* is less than an inner diameter of a pipe insertion hole out of the pipe insertion holes 32*c*. The inner diameter of the penetration hole 32*d* may be larger than the inner diameter of the pipe insertion hole 32*c*, and may equal to the inner diameter of the pipe insertion hole 32*c*.

The fixing plate 32*b* is a plate that curves along a circumferential surface on the inside of the tube member 31*a*. The fixing plate 32*b* is for example, fixed to the circumferential surface on the inside of the tube member 31*a*. A plurality of fixing plates 32*b* with spaces therebetween are disposed in the circumferential direction.

A first pipe 18*a* and the second pipe 18*b* are connected in the pressure container 30. The first pipe 18*a* and the second pipe 18*b* are pipes that configure a portion of the circulation path 18. As shown in FIG. 1, the first pipe 18*a* is a pipe that connects the four-way valve 16 to the pressure container 30. The second pipe 18*b* is a pipe that connects the compressor 12 to the pressure container 30. The first pipe 18*a* is an inflow pipe that causes the refrigerant 19 to flow in to the inside of the pressure container 30. The second pipe 18*b* is an outflow pipe that causes the refrigerant 19 to flow out from the inside of the pressure container 30.

As shown in FIG. 5, the first pipe 18*a* penetrates the upper lid member 31*b* in the vertical direction Z. The first pipe 18*a* has an extension pipe 18*c* that extends in the vertical direction Z, and penetrates the upper lid member 31*b* in the vertical direction Z, and a curved pipe 18*d* that extends in the horizontal direction from a bottom end of the extension pipe 18*c*. The curved pipe 18*d* is located on the inside of the container 31. An end of the curved pipe 18*d* is an end of the first pipe 18*a*, as well as being an inflow opening 18*h*, which opens to a portion that is located on the top of the partition member 32, out of the inside of the container 31. The inflow opening 18*h* for example, opens to the right (+Y direction) as well as to the bottom. The direction to which the inflow opening 18*h* opens to is not particularly limited. The inflow opening 18*h* is a bottom end out of parts of the first pipe 18*a* that are located on the inside of the pressure container 30, and is separately located above, more than the partition member 32.

The other end of the first pipe 18*a* is provided on a tip of a pipe that connects to an end on the top side of the extension pipe 18*c*. As shown in FIG. 1, the other end of the first pipe 18*a* is connected to the four-way valve 16, on an outside of the pressure container 30.

As shown in FIG. 4, the second pipe 18*b* has a first extension pipe 18*e*, a return pipe 18*f*, and a second extension pipe 18*g*. The first extension pipe 18*e* is located on the inside of the container 31. The first extension pipe 18*e* extends in the vertical direction Z. The first extension pipe 18*e* passes through one of the two pipe insertion holes 32*c* in the vertical direction Z. The first extension pipe 18*e* is fixed by being fitted to the inside of one of said pipe insertion holes 32*c*. An end on the top side of the first extension pipe 18*e* is an end of the second pipe 18*b*, and is an outflow opening 18*i* that opens to a portion located on the top of the partition member 32, out of the inside of the container 31. The outflow opening 18*i* opens to the top. The direction to which the outflow opening 18*i* opens to is not particularly limited. The outflow opening 18*i* is located above, more than the partition member 32. The outflow opening 18*i* is located below, more than the inflow opening 18*h*. The positional relationship of the inflow opening 18*h* and the outflow opening 18*i* is not particularly limited.

The second extension pipe 18*g* extends in the vertical direction Z. With the exception of an end on the top side, the second extension pipe 18*g* is located on the inside of the container 31. The second extension pipe 18*g* is passed through the other one of the two pipe insertion holes 32*c* in the vertical direction Z. The second extension pipe 18*g* is fixed by being fitted on the inside of said other one of the pipe insertion holes 32*c*. An end on the top side of the second extension pipe 18*g* is located above, more than the outflow opening 18*i*. The end on the top side of the second pipe 18*b* penetrates the upper lid member 31*b* in the vertical direction Z, and protrudes above from the upper lid member 31*b*. The second extension pipe 18*g* is disposed adjacently in the horizontal direction X to the first extension pipe 18*e*, with a space inbetween. The second extension pipe 18*g* for example, is located to the right (+Y direction) of the first extension pipe 18*e*.

A bottom end of the first extension pipe 18*e* and a bottom end of the second extension pipe 18*g* are connected to one another by the return pipe 18*f*. The return pipe 18*f* is a U-shaped pipe portion that opens to the top. The return pipe 18*f* is located on the bottom end of the inside of the container 31.

The other end of the second pipe 18*b* is provided on an end of the pipe that is connected to the end on the top side of the second extension pipe 18*g*. As shown in FIG. 1, the other end of the second pipe 18*b* is connected to the compressor 12. More specifically, the other end of the second pipe 18*b* is connected to an intake side of the compressor 12. Accordingly, the pressure container 30 is connected to the pressure intake side of the compressor 12. A pressure of the refrigerant 19 at the intake side of the compressor 12 is lower than the pressure of the refrigerant 19 at the discharge side of the compressor 12. In other words, the intake side of the compressor 12 is a low pressure side, and the discharge side of the compressor 12 is a high pressure side.

Figure 7:
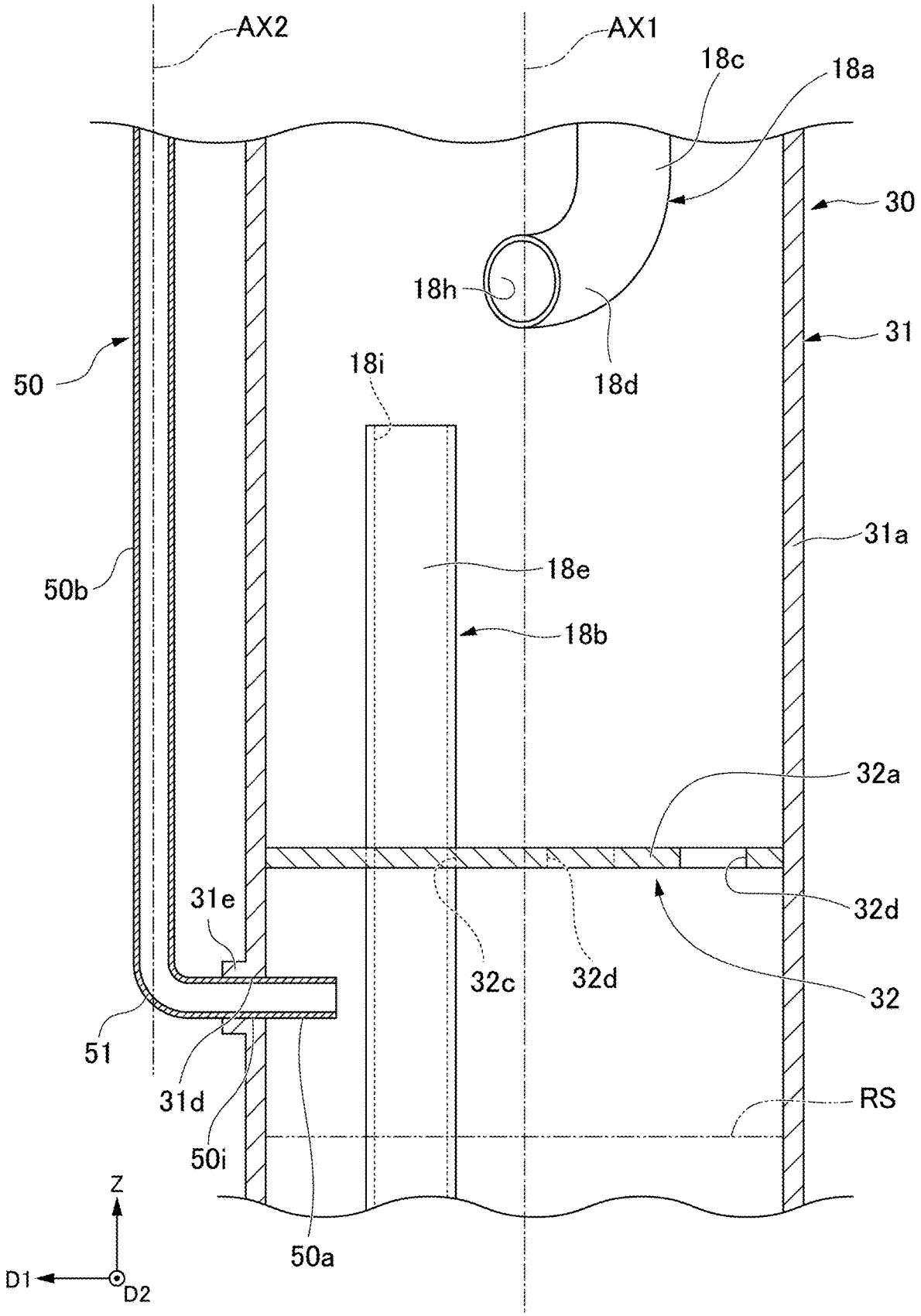
FIG. 7 A cross-sectional view that shows a portion of the pressure container and a portion of the relief pipe in the embodiment.

The refrigerant 19 flows in from the inflow opening 18*h* of the first pipe 18*a*, to a portion that is located above, more than the partition member 32, out of the container 31 of the pressure container 30. The refrigerant 19 that flows in to the inside of the container 31 from the inflow opening 18*h* is for example, in a two phase state of gas-liquid. The liquid state refrigerant 19 out of the refrigerant 19 that flows to the inside of the container 31 from the inflow opening 18*h*, flows to a part that is located below more than the partition member 32, out of the inside of the container 31, via the penetration hole 32*d* that is formed on the partition member 32, and is retained on the inside of the container 31. FIG. 7 is a cross-sectional view that shows a portion of the pressure container 30 and a portion of the relief pipe 50. As shown in FIG. 7, it is easy for a liquid surface RS of the refrigerant 19 that is retained on the inside of the container 31 for example, to be lower than the partition member 32.

The gas state refrigerant 19 out of the refrigerant 19 that flows to the inside of the container 31 from the inflow opening 18*h*, flows out to an inside of the second pipe 18*b* from the outflow opening 18*i*. The gas state refrigerant 19 that flows out to the inside of the second pipe 18*b* enters the inside of the compressor 12 from the intake side thereof, and is compressed by the compressor 12. As such, the refrigerant 19 in a two phase gas-liquid state that flows to the inside of the pressure container 30 is separated to gas and liquid by the separation member 32. Since it is possible to retain the liquid state refrigerant 19 on the inside of the pressure container 30, it is possible to suppress an excessive amount of the refrigerant 19 from flowing to the inside of the compressor 12.

As shown in FIG. 7, the relief pipe 50 is connected to the pressure container 30. An inside of the relief pipe 50 is connected to the inside of the pressure container 30. The relief pipe 50 in the present embodiment extends in a semi-L shape. The relief pipe 50 has a radial extension 50*a*, and a vertical extension 50*b*.

The radial extension 50*a* extends in the radial direction of the pressure container 30. The radial extension 50*a* in the present embodiment is a cylindrical tube that extends in the first direction D1 out of the radial direction. The radial extension 50*a* is passed through a fixing hole 31*d* that is formed on the tube member 31*a*, in the radial direction (first direction D1).

The fixing hole 31*d* penetrates the tube member 31*a* from a circumferential surface on the inside to a circumferential surface on the outside thereof, in the radial direction (first direction D1). A burring 31*e* is formed up as a cylindrical tube that protrudes to the outside (+D1 side) in the radial direction, on a circumferential edge portion of the fixing hole 31*d*, using burring. The fixing hole 31*d* is located below more than the partition member 32.

The radial extension 50*a* is located below, more than the partition member 32. An end on the inside (−D1 side) of in the radial direction of the radial extension 50*a* opens to a part that is located to below, more than the partition member 32 out of the container 31. An end on the inside in the radial direction of the radial extension 50*a* is located to the inside in the radial direction, more than the inner circumferential surface of the tube member 31*a*. An end on the outside in the radial direction of the radial extension 50*a* is located to the outside in the radial direction, more than the outer circumferential surface of the tube member 31*a*. Accordingly, the radial extension 50*a* protrudes to the outside in the radial direction, from the tube member 31*a*.

The radial extension 50*a* has a connector 50*i* that is connected to the pressure container 30. The connector 50*i* in the present embodiment is connected to the tube member 31*a*. The connector 50*i* for example, is fixed to the tube member 31*a* by welding or the like. The connector 50*i* is inserted to through the fixing hole 31*d* and an inside of the burring 31*e*, out of the radial extension 50*a*. A space between the connector 50*i* and the fixing hole 31*d* is sealed off. The connector 50*i* is located below, more than the partition member 32.

The vertical extension 50*b* extends in the vertical direction Z. The vertical extension 50*b* extends above from the end on the outside in the radial direction of the radial extension 50*a*. The vertical extension 50*b* is a cylindrical tube that opens to the top. The vertical extension 50*b* is disposed separately from the pressure container 30 in the first direction D1.

In the explanation below, an imaginary axis that passes through a center of the cylindrical tube vertical extension 50*b* is referred to as "a second center axis AX2". The second center axis AX2 is an imaginary axis that extends in the vertical direction Z. In the present embodiment, the second center axis AX2 and the first center axis AX1 are parallel. The second center axis AX2 may also extend in a direction that leans towards the first center axis AX1.

Figure 8:
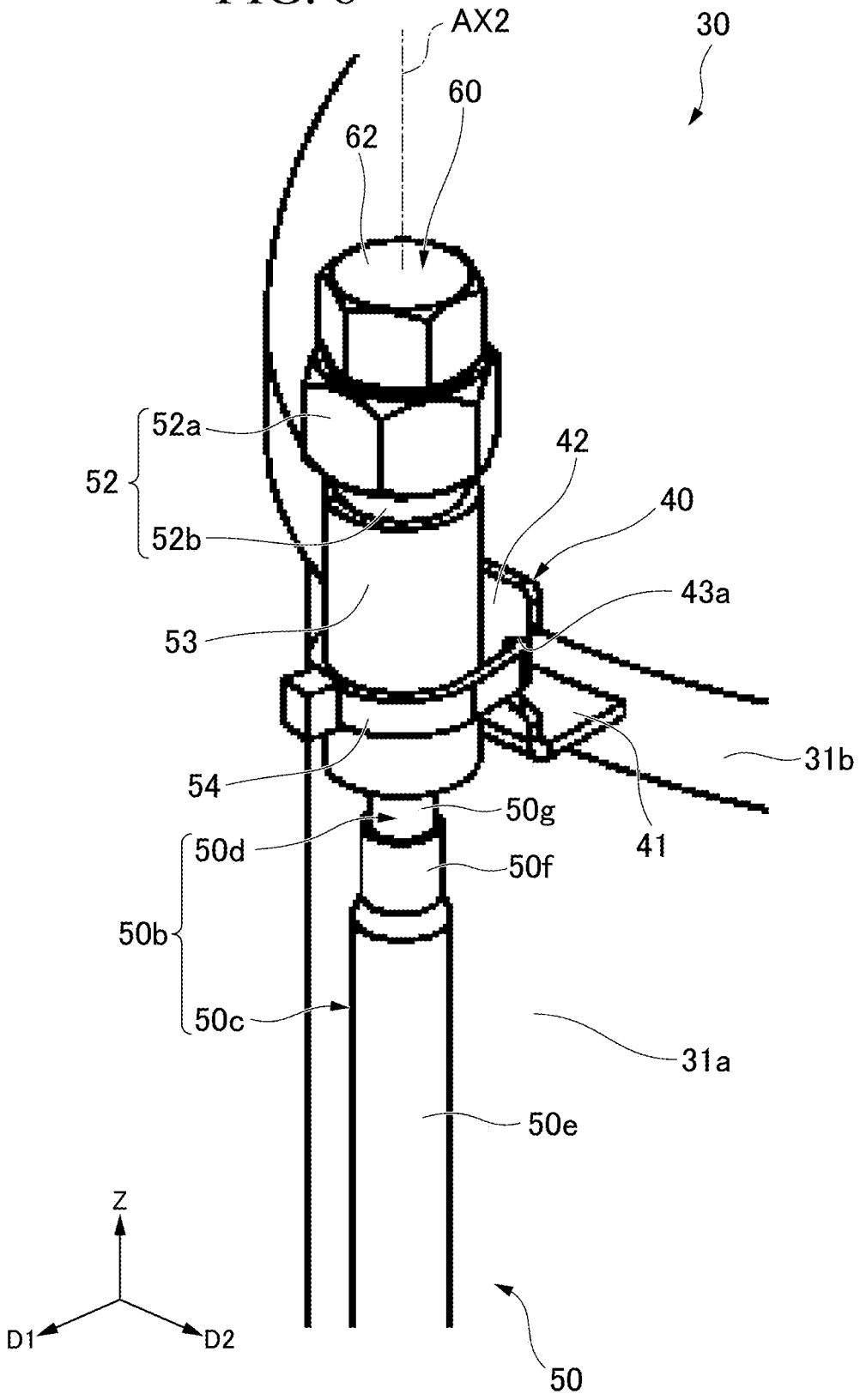
FIG. 8 A perspective view that shows a portion of the pressure container, a portion of the relief pipe, and the fusible plug in the embodiment.
Figure 9:
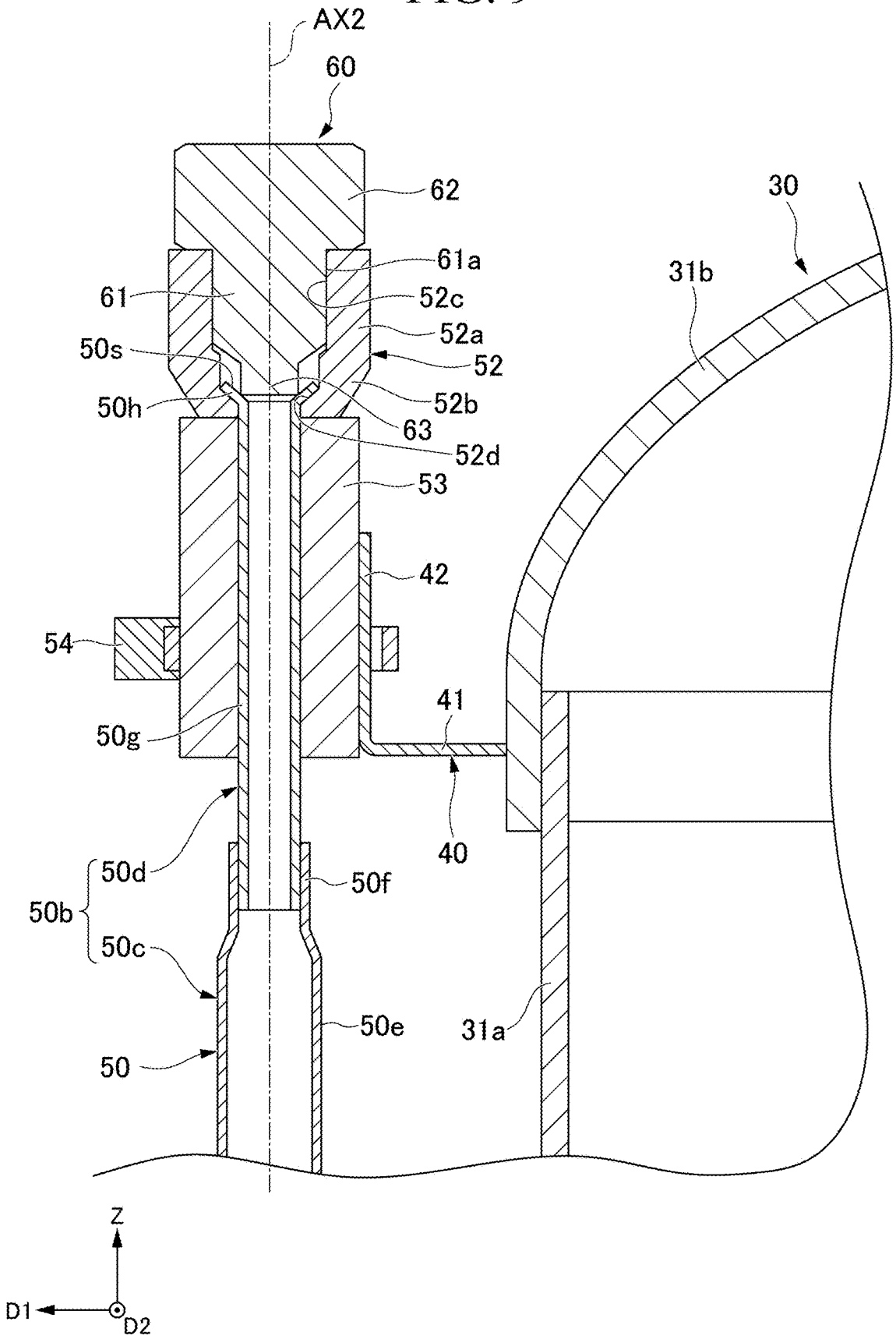
FIG. 9 A cross-sectional view that shows a portion of the pressure container, a portion of the relief pipe, and the fusible plug in the first embodiment.
Figure 10:
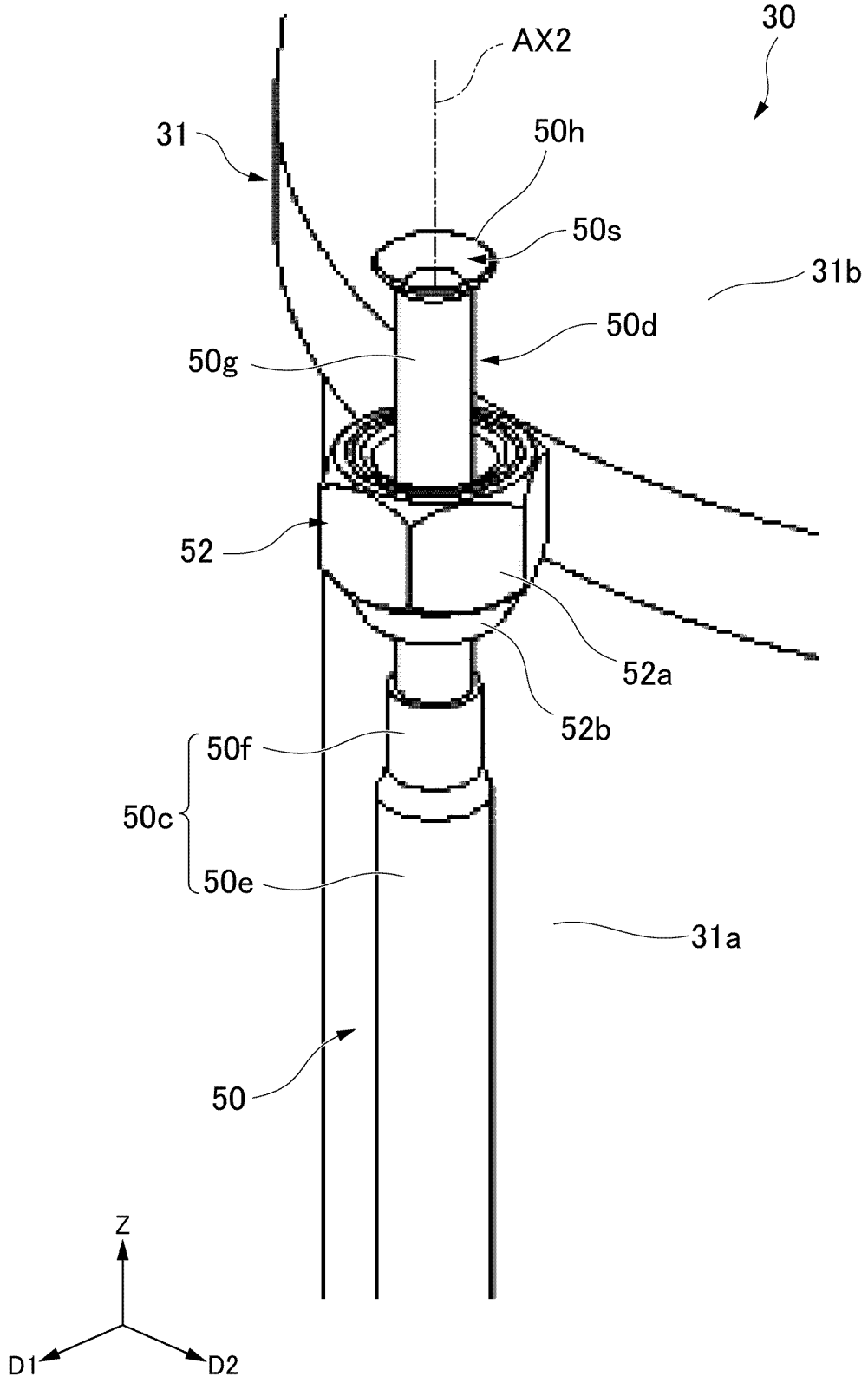
FIG. 10 A perspective view that shows a portion of steps for attaching the fusible plug to the relief pipe in the embodiment.
Figure 11:
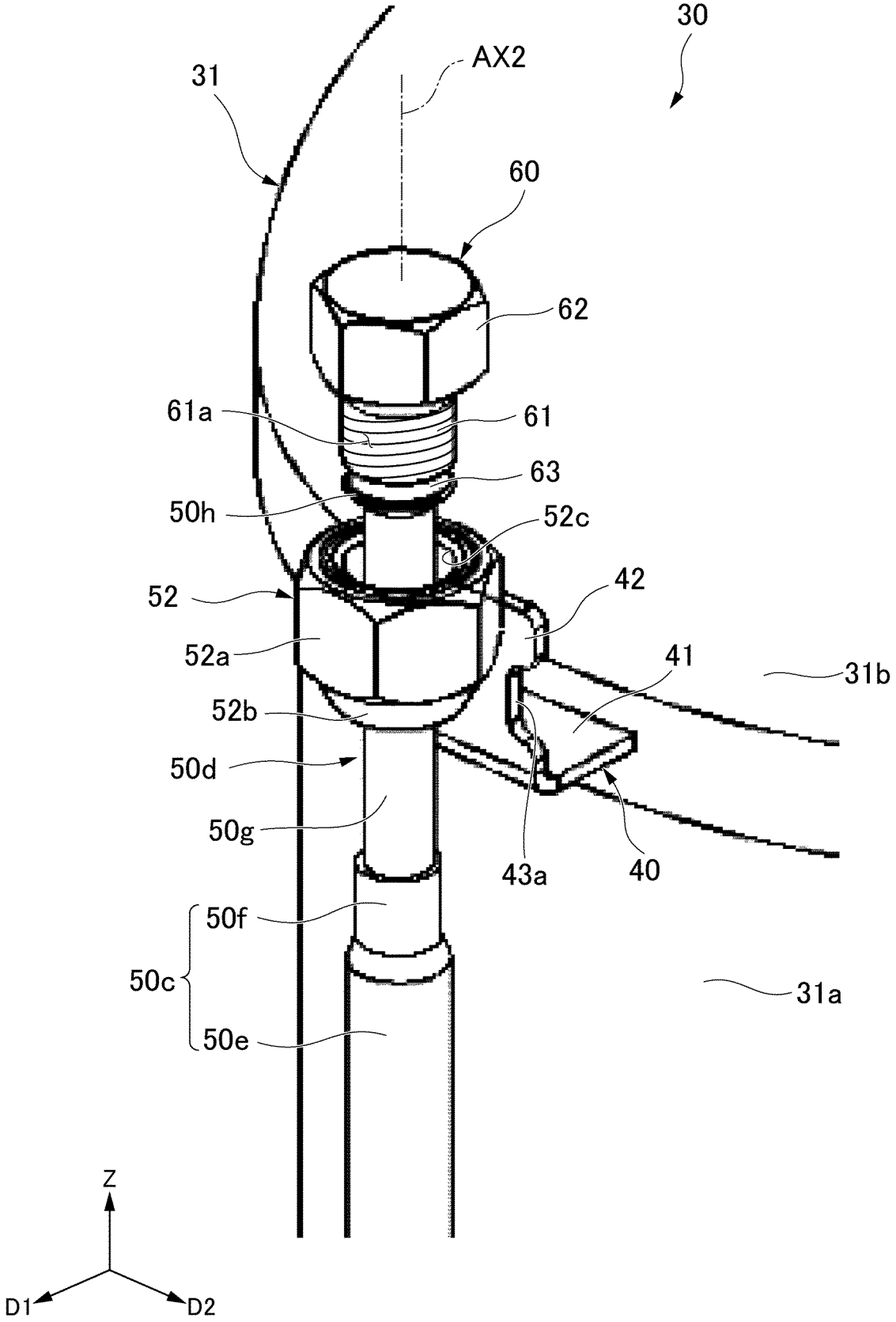
FIG. 11 A perspective view that shows another portion of steps for attaching the fusible plug to the relief pipe in the embodiment.

FIG. 8 is a perspective view that shows a portion of the pressure container 30, a portion of the relief pipe 50, and the fusible plug 60. FIG. 9 is cross-sectional view that shows a portion of the pressure container 30, a portion of the relief pipe 50, and the fusible plug 60. FIG. 10 is a perspective view that shows a portion of steps for attaching the fusible plug 60 to the relief pipe 50. FIG. 11 is a perspective view that shows another portion of steps for attaching the fusible plug 60 to the relief pipe 50.

As shown in FIG. 8 and FIG. 9, the vertical extension 50*b* has a main body pipe 50*c*, and a flare pipe 50*d* that is connected to the top of the main body pipe 50*c*. In the present embodiment, the main body pipe 50*c* and the flare pipe 50*d* are separate entities. The main body pipe 50*c* and the flare pipe 50*d* may be fixed to one another by welding or the like. The flare pipe 50*d* may be integrally formed with the main body pipe 50*c*.

The main body pipe 50*c* extends in the vertical direction Z, and is a cylindrical tube that opens to the top. The main body pipe 50*c* has a large diameter portion 50*e*, and a link 50*f* that is connected to an end on the top side of the large diameter portion 50*e*. The large diameter portion 50*e* and the link 50*f* are cylindrical tubes that extend in the vertical direction Z. An end on the top side of the link 50*f* is an end on the top side of the main body pipe 50*c*. An outer diameter of the link 50*f* is smaller than the outer diameter of the large diameter portion 50*e*. An inner diameter of the link 50*f* is smaller than an inner diameter of the large diameter portion 50*e*. An end on the bottom side of the main body pipe 50*c* and an end on the outside in the radial direction of the radial extension 50*a* are connected to one another for example, by being integrally formed.

As shown in FIG. 9 and in FIG. 10, the flare pipe 50*d* is a cylindrical tube that extends in the vertical direction Z, and that opens to both sides in the vertical direction Z. The flare pipe 50*d* has a small diameter portion 50*g*, and an expansion diameter portion 50*h*. The small diameter portion 50*g* is a cylindrical tube that extends in the vertical direction Z. The small diameter portion 50*g* is located on top of the large diameter portion 50*e*. An outer diameter of the small diameter portion 50*g* is smaller than the outer diameter of the large diameter portion 50*e*, and the outer diameter of the link 50*f*. An inner diameter of the small diameter portion 50*g* is smaller than the inner diameter of the large diameter portion 50*e* and the inner diameter of the link 50*f*. An end on the bottom side of the small diameter portion 50*g* is fitted and fixed to an inside of the link 50*f* of the main body pipe 50*c*.

The expansion diameter portion 50*h* is formed on an end on the top side of the small diameter portion 50*g*. The expansion diameter portion 50*h* expands above from an end on the top side of the small diameter portion 50*g*, as well as an outside in the radial direction, having the second center axis AX2 as a center thereof. An inner diameter and an outer diameter of the expansion diameter portion 50*h* become larger as the top is approached. Inner circumferential surfaces and outer circumferential surfaces of the expansion diameter portion 50*h* are the same shape as an outer circumferential surface of a truncated cone having a diameter that becomes larger as the top is approached. The expansion diameter portion 50*h* is an end on the top side of the vertical extension 50*b*. The end on the top side of the expansion diameter portion 50*h* is located above, more than the end on the top side of the tube member 31*a*, and an end on the top side of the attachment member 40. The end on the top side of the expansion diameter portion 50*h* is located below, more than an end on the top side of the upper lid member 31*b*. The expansion diameter portion 50*h* is a portion that attaches to the fusible plug 60.

The expansion diameter portion 50*h* opens to the top. An opening of the expansion diameter portion 50*h* is an opening 50*s* that is formed on the relief pipe 50. The opening 50*s* in the present embodiment opens to the top. As shown in FIG. 9, the opening 50*s* is plugged by the fusible plug 60. As shown in FIG. 10, the opening 50*s* opens to the outside of the pressure container 30 when the fusible plug 60 is not attached. The opening 50*s* is located above, more than the end on the top side of the tube member 31*a*.

As shown in FIG. 5 and in FIG. 7, a connection portion of the radial extension 50*a* and the vertical extension 50*b* is a bend 51 that bends towards the top when moving towards the vertical extension 50*b* from the radial extension 50*a*. The bend 51 is formed on a connection portion between an end on the bottom side of the vertical extension 50*b* and the end on the outside in the radial direction of the radial extension 50*a*. In other words, the end on the bottom side of the vertical extension 50*b* is connected to the end on the outside in the radial direction of the radial extension 50*a* via the bend 51. The bend 51 is located on the outside in the radial direction (+D1 side) more than the connector 50*i*. As shown in FIG. 5, the bend 51 is located below, more than the opening 50*s*. The bend 51 is formed on a portion that is located between the connector 50*i* and the opening 50*s* out of the relief pipe 50.

As shown in FIG. 9, the fusible plug 60 is attached to the relief pipe 50. More specifically, the fusible plug 60 is attached to an end on the top side of the vertical extension 50*b*, in other words, is attached to the expansion diameter portion 50*h*. The fusible plug 60 plugs the opening 50*s* that is formed on the relief pipe 50. As shown in FIG. 9 and FIG. 11, the fusible plug 60 is a bolt having a male thread 61*a* formed on an outer circumferential surface thereof. The fusible plug 60 is disposed so as to be coaxial with the vertical extension 50*b*, having the second center axis AX2 as a center thereof. The fusible plug 60 has a bolt main body 61, a head 62, and a plug 63.

The bolt main body 61 is a cylindrical shaft that extends in the vertical direction Z, having the second center axis AX2 as a center thereof. The male thread 61*a* is formed on an outer circumferential surface of the bolt main body 61. The head 62 is connected to an end on the top side of the bolt main body 61. The head 62 in the present embodiment is hexagonal. The head 62 protrudes to the outside more than the bolt main body 61, in the radial direction, having the second center axis AX2 as a center thereof.

The plug 63 is connected to an end on the bottom side of the bolt main body 61. The plug 63 is a cylindrical shaft having the second center axis AX2 as a center thereof. An outer diameter of the plug 63 is larger than an inner diameter of an end on a bottom side of the expansion diameter portion 50*h*, and smaller than an inner diameter of an end on the top side of the expansion diameter portion 50*h*. An end on a bottom side of the plug 63 is inserted through an inside of the expansion diameter portion 50*h* from the top, and is in contact with an inner circumferential surface of the expansion diameter portion 50*h*. The inside of the expansion diameter portion 50*h* is plugged by the plug 63. As such, an opening on the top side of the vertical extension 50*b*, in other words the opening 50*s*, is plugged by the fusible plug 60.

The fusible plug 60 in the present embodiment is located above, more than the partition member 32. The fusible plug 60 is located above, more than the end on the top side of the tube member 31*a*. An end on the top side of the fusible plug 60 is for example, located on the same location as an end on the top side of the pressure container 30. The end on the top side of the fusible plug 60 in the present embodiment, is an end on the top side of the head 62.

Materials that configure the fusible plug 60 are alloys having relatively low melting points. The melting point of the fusible plug 60 is for example, set to be less than a critical temperature of the refrigerant 19 that is used. As an example, in a state where R410 is used as the refrigerant 19, since the critical temperature of R410A is 71.4 degrees Celsius, the melting temperature of the fusible plug 60 is set to 70 degrees, which is a temperature that is less than 71.4 degrees Celsius. However, the melting temperature of the fusible plug 60 is not particularly limited, and it is possible to suitably set the melting temperature according to the type of the refrigerant 19 being used.

For example, when abnormal pressure is generated on an inside of the circulation path 18 as the outdoor unit 10 is operated, pressure inside of the pressure container 30 rises, and a temperature of the inside of the pressure container 30 rises above the melting temperature of the fusible plug 60. Accordingly, the fusible plug 60 melts, and pressure is released to the outside of the pressure container 30 from the opening 50*s* of the relief pipe 50. Therefore, it is possible to decrease the pressure on the inside of the pressure container 30 by having the refrigerant 19 on the inside of the pressure container 30 be released to the outside of the pressure container 30 via the opening 50*s*. As such, it is possible to suppress damage to various pipes that have the refrigerant 19 flowing through, and it is possible to suppress abnormal operation of the outdoor unit 10.

The fusible plug 60 in the present embodiment is fixed to the relief pipe 50 via a flare nut 52. The flare nut 52 is a member to fix the fusible plug 60 to the relief pipe 50. As shown in FIG. 9, the flare nut 52 is a tube that opens to both sides in the vertical direction Z. The bolt main body 61 and the plug 63 on the fusible plug 60, and the expansion diameter portion 50*h* are located on an inside of the inside of the flare nut 52.

A female thread 52*c* and a support 52*d* are formed on an inner circumferential surface of the flare nut 52. The female thread 52*c* is formed on an inner circumferential surface of a top side portion 52*a* of the flare nut 52. The female thread 52*c* engages with the male thread 61*a* that is formed on an outer circumferential surface of the fusible plug 60. The support 52*d* is formed on an inner circumferential surface of a bottom side portion 52*b* of the flare nut 52. The support 52*d* is located below, more than the female thread 52*c*, and above more than an end on a bottom side of the flare nut 52. The support 52*d* is a portion that becomes smaller as an inner diameter thereof moves towards the bottom side. The support 52*d* supports the expansion diameter portion 50*h* from below.

A small diameter portion 50*g* is inserted through the end on the bottom side of the flare nut 52. An inner diameter on the end on the bottom side of the flare nut 52 is larger than the outer diameter of the small diameter portion 50*g*. The inner diameter on the end on the bottom side of the flare nut 52 is smaller than an inner diameter on an end on a top side of the flare nut 52, the outer diameter of the expansion diameter portion 50*h*, the outer diameter of the link 50*f*, and the outer diameter of the large diameter portion 50*e*.

The head 62 of the fusible plug 60 is connected to an end surface on the top side of the flare nut 52. A space between the end surface on the top side of the flare nut 52 and a bottom surface of the head 62 is sealed off. As shown in FIG. 10, the top side portion 52*a* of the flare nut 52 in the present embodiment has the same shape as a hexagonal nut. An outer diameter of the bottom side portion 52*b* of the flare nut 52 becomes smaller as the bottom is approached.

As shown in FIG. 9, by threading the male thread 61*a* of the fusible nut 60 to the female thread 52*c* of the flare nut 52, along with having the support 52*d* be pushed against the expansion diameter portion 50*h* from the bottom, the plug 63 of the fusible plug 60 is pushed against the expansion diameter portion 50*h* from the top. Accordingly, the fusible plug 60 is fixed to the relief pipe 50, and the opening 50*s* is plugged by the fusible plug 60.

The outdoor unit 10 in the present embodiment includes an elastic member 53. The elastic member 53 is attached to the vertical extension 50*b*. In the present embodiment, the elastic member 53 is attached to the small diameter portion 50*g*. The elastic member 53 extends in the vertical direction Z, and is a member, which is a cylindrical tube that opens to both sides in the vertical direction Z. Rubber is an example of a material that configures the elastic member 53. A rubber tube is an example of elastic member 53. The elastic member 53 is fixed to an outer circumferential surface of the small diameter portion 50*g*. The elastic member 53 surrounds the small diameter portion 50*g*. As in the example of FIG. 9, an end on a top side of the elastic member 53 contacts the end on the bottom side of the flare nut 52. The elastic member 53 is located on the outside in the radial direction (+D1 side) of the attachment plate 42 of the attachment member 40, and contacts a surface on an outside in the radial direction of the attachment plate 42. Although not shown on the drawings, a slit that extends in the vertical direction Z from a top end of the elastic member 53 to a bottom end thereof is formed on the elastic member 53. By having said slit expand, it is possible to have the elastic member 53 be detachable with respect to the small diameter portion 50*g*, in a radial direction having the second center axis AX2 as a center thereof.

When the at least a portion of the elastic member 53 is sandwiched between the vertical extension 50*b* and the attachment member 40, the outdoor unit 10 includes a tie band 54 that fixes the vertical extension 50*b* to the attachment member 40. In the present embodiment, a portion out of the elastic member 53, which is disposed in a location that is closer to the attachment plate 42 more than the small diameter portion 50*g*, is sandwiched in the radial direction (the first direction D1) between the small diameter portion 50*g* and the attachment plate 42. The tie band 54 is a ring that surrounds the small diameter portion 50*g*, the elastic member 53, and the attachment plate 42. The tie band 54 contacts the elastic member 53 and the attachment plate 42, and pushes the elastic member 53 and the attachment plate 42 against one another. As shown in FIG. 8, the tie band 54 is passed inside of a recess 43*a* that is formed on the attachment plate 42. Although omitted from the drawings, the tie band 54 is passed inside of a recess 43*b* that is formed on the attachment plate 42.

As shown in FIG. 10, in a state prior to where the fusible plug 60 is attached to the relief pipe 50, the flare nut 52 is separately located below, more than the expansion diameter portion 50*h*. As shown in FIG. 11, the flare nut 52 is moved to the top after an operator disposes the fusible plug 60 in the expansion diameter portion 50*h* from the top. After the female thread 52*c* of the flare nut 52 contacts the male thread 61*a* of the fusible plug 60, the operator engages the male thread 61*a* and the female thread 52*c* by turning the flare nut 52 or the fusible plug 60 about the second center axis AX2, using a wrench or the like. Accordingly, the fusible plug 60 is attached to the relief pipe 50. After attaching the fusible plug 60 to the relief pipe 50, the operator mounts the elastic member 53 onto the small diameter portion 50*g*, and fixes the elastic member 53 along with the small diameter portion 50*g* to the attachment plate 42 using the tie band 54.

According to the present embodiment, the outdoor unit 10 includes the compressor 12, the pressure container 30 connected to the compressor 12, the relief pipe 50 connected to the pressure container 30, and the fusible plug 60 that plugs the opening 50*s* formed on the relief pipe 50. The relief pipe 50 has the connector 50*i* that is connected to the pressure container 30, and the bend 51 formed on a portion out of the relief pipe 50 that is located between the connector 50*i* and the opening 50*s*. By having the bend 51 be formed from the connector 50*i* to the opening 50*s*, it becomes more difficult for the refrigerant 19 to reach the opening 50*s* from the connector 50*i*, on the inside of the relief pipe 50. As such, even if the refrigerant 19 having high pressure and high temperature flows to the inside of the pressure container 30 from the first pipe 18*a* or from the second pipe 18*b*, it is possible to suppress the refrigerant 19 having high pressure and high temperature from passing through the relief pipe 50 up to the fusible plug 60, which plugs the opening 50*s*. As such, it is possible to prevent the fusible plug 60 from melting accidentally. Therefore, in a state where the pressure need not be relieved to the inside of the pressure container 30, the fusible plug 60 suppresses the pressure from being released to the inside of the pressure container 30, and prevents the refrigerant 19 from being discharged out from the inside of the pressure container 30. From the aforementioned, it is possible to obtain a highly reliable outdoor unit 10 according to the present embodiment.

In a state where the outdoor unit 10 is operating under normal conditions, the refrigerant 19 flows in from the inflow opening 18*h* of the first pipe 18*a* to the inside of the pressure container 30, regardless of the condition of the indoor unit 20. On the other hand, for example, in a state where the refrigeration cycle device 100 abnormally stops due to a power outage or the like, there is a risk of backflow of the refrigerant 19 that has high pressure and high temperature, due to the compressor 12, from the outflow opening 18*i* of the second pipe 18*b* to the inside of the pressure container 30. When an abnormality in the switching of the four-way valve 16 occurs, there is a risk that the refrigerant 19, which has high pressure and high temperature, and that is discharged to the four-way valve 16 from the compressor 12, flows to the first pipe 18*a* and to the inside of the pressure container 30, from the four-way valve 16.

As an example, it is possible that fusible plugs may be fixed to other pipes. However, in such a case, since the fusible plugs are usually disposed at locations that are close to connection portions that make up the circulation path 18, there is a risk of any one of the fusible plugs melting due to heat generated when the pipes are connected to one another while conducting welding operations. With respect to the aforementioned, in the present embodiment, by connecting the relief pipe 50 to the pressure container 30, and by attaching the fusible plug 60 to the relief pipe 50, separating the fusible plug 60 from locations where connection portions that make up the circulation path 18 becomes easier. Accordingly, it is possible to suppress heat that may cause the fusible plug 60 to melt, which is generated from welding operations when connecting said pipes to one another. Therefore, it is possible to suppress having the fusible plug 60 be melted inadvertently when conducting assembly work of the pipes of the outdoor unit 10.

Also, by extending the relief pipe 50 from the pressure container 30, it is possible to determine a location where the fusible plug 60 is attached to, regardless of where the pressure container 30 is located. As such, it is possible to have the opening 50*s* of the relief pipe 50 be located in an open space having a relatively fewer number of pipes, which makes it easier to conduct attachment work of the fusible plug 60. Accordingly, it is possible to increase assemblability of the outdoor unit 10.

According to the present embodiment, the relief pipe 50 has the vertical extension 50*b*, which extends in the vertical direction Z. The fusible plug 60 is attached on the end on the top side of the vertical extension 50*b*. As such, it is possible to have the location of the fusible plug 60 in the vertical direction Z be higher than the liquid surface RS of the refrigerant 19 being stored on the inside of the pressure container 30 in a liquid state. Accordingly, it is to maintain having the refrigerant 19 in a gaseous state be in contact with the fusible plug 60. Therefore, even when a portion of the refrigerant 19 on the inside of the pressure container 30 evaporates due to a rising temperature of the inside of the pressure container 30, and the refrigerant 19 at the vicinity of the liquid surface RS is in a two phase gas-liquid state, it is possible to suppress the refrigerant 19 in said two phase gas-liquid state from coming into contact with the fusible plug 60. Therefore, it is possible to suppress having the fusible plug 60 inadvertently melt due to coming into contact with the refrigerant 19 that is in a two phase gas-liquid state.

According to the present embodiment, the pressure container 30 has the tube member 31*a* that extends in the vertical direction Z, and the upper lid member 31*b* that is attached to the end on the top side of the tube member 31*a*. The fusible plug 60 is located above, more than the end on the top side of the tube member 31*a*. As such, it is possible to easily have a location of the fusible plug 60 in the vertical direction Z be located suitably above, more than the liquid surface RS of the refrigerant 19, which is in a liquid state and is retained on the inside of the pressure container 30. Therefore, it is possible to suitably suppress the fusible plug 60 from inadvertently melting due to the refrigerant 19 that is in a two phase gas-liquid state.

According to the present embodiment, the outdoor unit 10 includes the flare nut 52, which fixes the fusible plug 60 to the relief pipe 50. The vertical extension 50*b* has the large diameter portion 50*e*, the small diameter portion 50*g* that has an outer diameter that is smaller than the large diameter portion 50*e* and is located above the large diameter portion 50*e*, and the expansion diameter portion 50*h* that is formed on the end on the top side of the small diameter portion 50*g*, and has an outer diameter thereof become larger as the top is approached. The expansion diameter portion 50*h* is located on the inside of the flare nut 52. The male thread 61*a* is formed on the outer circumferential surface of the fusible plug 60. The female thread 52*c* that engages with the male thread 61*a*, and the support 52*d* that supports the expansion diameter portion 50*h* from below, are formed on the inner circumferential surface of the flare nut 52. The small diameter portion 50*g* is passed through the end on the bottom side of the flare nut 52. As such, it is possible to suitably fix the fusible plug 60 with respect to the relief pipe 50 using the flare nut 52. The inner diameter at the end on the bottom side of the flare nut 52 is smaller than the outer diameter of the large diameter portion 50*e*. Therefore, even if the flare nut 52 moves to the bottom due to its own weight before attaching the fusible plug 60 to the relief pipe 50, the flare nut 52 does not move below, more than an end on the top of the large diameter portion 50*e*. Accordingly, it is possible to fix the flare nut 52 to the expansion diameter portion 50*h*, at a relatively close location. Therefore, conducting fixing work of the fusible plug 60 using the flare nut 52 becomes easier. When conducting attachment work of the fusible plug 60, even if the operator inadvertently releases the flare nut 52, the flare nut 52 is suppressed from falling to a bottom end in the vertical extension 50*b*. As such, it is easy for the operator to once again take a hold of the flare nut 52 by hand, which makes for a speedy recovery of the attachment work of the fusible plug 60.

According to the present embodiment, the outdoor unit 10 includes the attachment member 40 that is fixed to the pressure container 30, the elastic member 53 that is attached to the vertical extension 50*b*, and the tie band 54 that fixes the vertical extension 50*b* to the attachment member 40 when at least a portion of the elastic member 53 is sandwiched between the vertical extension 50*b* and the attachment member 40. Therefore, it is possible to fix the vertical extension 50*b* that extends in the vertical direction Z to the pressure container 30 via the attachment member 40, and it is possible to suppress the vertical extension 50*b* from vibrating. Accordingly, it is possible to prevent the vertical extension 50*b* from repeatedly colliding with the pressure container 30. Since a portion of the elastic member 53 is located between the vertical extension 50*b* and the attachment member 40, it is possible to suppress vibration during operation of the outdoor unit 10, and it is possible to prevent vibration that occurs when transporting the outdoor unit 10 from being transmitted to the relief pipe 50. Accordingly, it is possible to suppress defects such as the fusible plug 60 from coming off of the relief pipe 50 due to vibration.

According to the present embodiment, the elastic member 53 is attached to the small diameter portion 50*g*, out of the vertical extension 50*b*. The tie band 54 fixes the small diameter portion 50*g* to the attachment member 40, in a state where at least a portion of the elastic member 53 is sandwiched between the small diameter portion 50*g* and the attachment member. Since the outer diameter of the large diameter portion 50*e* is smaller than the outer diameter of the small diameter portion 50*g*, compared to when the elastic member 53 is attached to the large diameter portion 50*e*, attaching the elastic member 53 to the small diameter portion 50*g* is easier. Since the small diameter portion 50*g* has the expansion diameter portion 50*h* formed on a top end thereof, and has an outer diameter that is smaller than the large diameter portion 50*e*, the small diameter portion 50*g* easily stands out as a portion to which the elastic member 53 is attached to. Accordingly, it is easy for the operator to identify the location to which the elastic member 53 is to be attached to. Therefore, attachment work of the elastic member 53 to the vertical extension 50*b* becomes easier.

According to the present embodiment, each of the pair of recesses 43*a* and 43*b* is formed on each end out of both ends of the attachment plate 42 in the second direction D2. The tie band 54 passes through the pair of recesses 43*a* and 43*b*. As such, the tie band 54 is suppressed from shifting in the vertical direction Z with respect to the attachment plate 42. Accordingly, it is possible to suppress the tie band 54 from coming loose, and it is possible to suppress the vertical extension 50*b* from coming off of the attachment member 40.

According to the present embodiment, the attachment member 40 is fixed to the upper lid member 31*b*. It is easier to have the upper lid member 31*b* be dimensionally smaller, compared to the tube member 31*a*. Therefore, when using an automatic welding machine to weld the attachment member 40 to the pressure container 30 for example, setting the upper lid member 31*b* on said automatic welding machine is easy, and conducting attachment work of attaching the attachment member 40 to the upper lid member 31*b* using the automatic welding machine becomes easier.

According to the present embodiment, the pressure container 30 is a tube shape that extends in the vertical direction Z. The relief pipe 50 has the vertical extension 50*b* that extends in the radial direction of the pressure container 30. The radial extension 50*a* has the connector 50*i*, and protrudes from the pressure container 30 to the outside in the radial direction. The end on the bottom side of the vertical extension 50*b* is connected to the end on the outside in the radial direction of the radial extension 50*a* via the bend 51. As such, the relief pipe 50 has a relatively simple construction where only one of the bend 51 is provided, and the fusible plug 60 is suppressed from being inadvertently welded.

According to the present embodiment, the outdoor unit 10 includes the first pipe 18*a* that is connected to the pressure container 30, and the second pipe 18*b*. The pressure container 30 has the container 31, and the partition member 32 that partitions the inside of the container 31 in the vertical direction Z. An end of the first pipe 18*a* and an end of the second pipe 18*b* open to a portion that is located on the top side of the out of the inside of the pressure container 30. The connector 50*i* is located below, more than the partition member 32. As such, even in a state where the refrigerant 19 having high temperature and high pressure flows to the inside of the container 31 from the first pipe 18*a* or the second pipe 18*b*, the refrigerant 19 having high temperature and high pressure is blocked by the partition member 32, and it is possible to make flowing to the inside of the relief pipe 50 difficult. The partition member 32 also functions as a buffer that separates the refrigerant 19 in the two phase gas-liquid state, having the refrigerant 19 in a liquid phase be retained in a location lower than the partition member 32, out of the container 31. Since a temperature of the refrigerant 19 that is retained on the inside of the container 31 is relatively low, even if the refrigerant 19 having high temperature and high pressure flows to a location that is lower than the partition member 32 via the penetration hole 32*d*, the temperature of said refrigerant 19 having high temperature and high pressure is reduced by the retained refrigerant 19. Accordingly, it is possible to suitably suppress the refrigerant 19 having high temperature and high pressure from flowing into the relief pipe 50. From the above, it is possible to suitably suppress the fusible plug 60 from inadvertently melting.

According to the present embodiment, the fusible plug 60 is located above, more than the partition member 32. As such, it is easier to have the location of the fusible plug 60 in the vertical direction Z be higher than the liquid surface RS of the refrigerant 19 that is retained on the inside of the pressure container 30, which is retained on the inside of the pressure container. Accordingly, similar to the aforementioned explanation, it is possible to have the fusible plug 60 be inadvertently melted by the refrigerant 19 in a two phase gas-liquid state.

According to the present embodiment, the pressure container 30 is connected to the intake side of the compressor 12. As such, it is difficult to have the refrigerant 19 having high temperature and high pressure flow to the inside of the pressure container 30, and it is possible to suitably suppress the fusible plug 60 from being inadvertently melted.

Although embodiments of the present disclosure are explained above, configurations of the present disclosure are not particularly limited thereto, and it is possible to adopt the configurations and methods mentioned below.

So long as a relief pipe has at least one bend that is formed on a portion, which is located between a connector that is connected to a pressure container out of the relief pipe and an opening that is formed on the relief pipe, the relief pipe may be any shape. Two bends or more may be formed on the relief pipe. The relief pipe may extend from the connector in any manner, and may extend towards the bottom in a vertical direction from the connector. The opening may be formed on any location on the relief pipe. The opening need not be formed on a tip end of the relief pipe, and may be formed on a side surface of the relief pipe. The connector of the relief pipe may be connected anywhere on the pressure container. The connector of the relief pipe may be connected to a portion that is located above, more than a partition member out of a tube member of the pressure container, and may be connected to an upper lid member out of the pressure container. The relief pipe may be an integrally formed pipe, or may be a pipe configured of two or more pipes that are linked together.

A shape of a fusible plug is not particularly limited. A relative location of the fusible plug with respect to the pressure container is not particularly limited. The fusible plug may be located above in the vertical direction, more than an end on the top of the pressure container in the vertical direction. The fusible plug may be located below in the vertical direction, more than an end on the bottom the tube material of the pressure container in the vertical direction. The fusible plug may be fixed in any manner with respect to the relief pipe. The pressure container may be constructed in any manner, and need not be constructed as an accumulator. The pressure container may be connected to the discharge side of a compressor. The pressure container may be disposed in any location on an inside of a housing of an outdoor unit.

So long as a refrigeration cycle device included in the outdoor unit of the present disclosure is a device that uses a refrigeration cycle that cycles a refrigerant, the refrigeration cycle device is not limited to an air conditioner. The refrigeration cycle device may be a heat pump of a water heater or the like.

Relative locations and dimensions of the various aforementioned embodiments are only one example, and are not particularly limited, so long as the various relative locations and dimensions or the like in the present disclosure do not depart from the technical scope of the present disclosure. The various configurations and various methods explained above may be combined as needed, so long as no conflicts in the technical scope thereof occurs.

REFERENCE SIGNS LIST

10 . . . Outdoor Unit, 12 . . . Compressor, 18*a* . . . First Pipe, 18*b* . . . Second Pipe, 20 . . . Indoor Unit, 30 . . . Pressure Container, 31 . . . Container, 31*a* . . . Tube Member, 31*b* . . . Upper Lid Member, 32 . . . Partition Member, 40 . . . Attachment Member, 50 . . . Relief Piping, 50*a* . . . Radial Extension, 50*b* . . . Vertical Extension, 50*e* . . . Large diameter portion, 50*g* . . . Small diameter portion, 50*h* . . . Expansion diameter portion, 50*i* . . . Connector, 50*s* . . . Opening, 51 . . . Bend, 52 . . . Flare Nut, 52*c* . . . Female Thread, 52*d* . . . Support, 53 . . . Elastic Member, 54 . . . Tie Band, 60 . . . Fusible Plug, 61*a* . . . Male Thread, 100 . . . Refrigeration Cycle Device, Z . . . Vertical Direction

The invention claimed is:

1. An outdoor unit of a refrigeration cycle device comprising:

a compressor;

a pressure container that is connected to the compressor;

a relief pipe that is connected to the pressure container; and a fusible plug that plugs an opening that is formed on the relief pipe;

wherein the relief pipe has a connector that is connected to the pressure container, at least one bend that is formed on a portion that is located between the connector and the opening, out of the relief pipe, and a vertical extension that extends in a vertical direction, the pressure container has a tube member that extends in the vertical direction, and an upper lid member that is attached to an end on the top side in the vertical direction of the tube member, and the fusible plug is attached to an end on a top side in the vertical direction of the vertical extension, and the fusible plug is located above, more than an end on the top side in the vertical direction of the tube member.

2. The outdoor unit according to claim 1 further comprising:

a flare nut to fix the fusible plug to the relief pipe;

wherein the vertical extension has a large diameter portion, a small diameter portion that is located above the large diameter portion in the vertical direction, and that has an outer diameter that is smaller than the large diameter portion, and an expansion diameter portion that is formed on an end on the top side in the vertical direction of the small diameter portion, and has an outer diameter thereof become larger as the top in the vertical direction is approached, the expansion diameter portion is located on an inside of the flare nut, a male thread is formed on an outer circumferential surface of the fusible plug, on an inner circumferential surface of the flare nut a female thread that engages with the male thread, and a support that supports the expansion diameter portion from below are formed, the small diameter portion is passed through an end on a bottom side of the flare nut, and an inner diameter at the end on the bottom side of the flare nut is smaller than an outer diameter of the large diameter portion.

3. The outdoor unit according to claim 2 further comprising:

an attachment member that is fixed to the pressure container;

an elastic member that is attached to the small diameter portion; and a tie band that fixes the small diameter portion to the attachment member, in a state where at least a portion of the elastic member is sandwiched between the small diameter portion and the attachment member.

4. The outdoor unit according to claim 1 further comprising:

an attachment member that is fixed to the pressure container;

an elastic member is attached to the vertical extension; and a tie band that fixes the vertical extension to the attachment member, in a state where at least a portion of the elastic member is sandwiched between the vertical extension and the attachment member.

5. The outdoor unit according to claim 3, wherein the attachment member is fixed to the upper lid member.

6. The outdoor unit according to claim 1, wherein the pressure container is a cylindrical shaft that extends in the vertical direction, the relief pipe has a radial extension that extends in a radial direction of the pressure container, the radial extension has the connector, and protrudes to the outside in the radial direction from the pressure container, and an end on a bottom side of the vertical extension is connected to an end on an outside in the radial direction of the radial extension via the bend.

7. The outdoor unit according to claim 1 further comprising:

a first pipe and a second pipe that are connected to the pressure container; wherein the pressure container has a container, and a partition member that partitions an inside of the container in the vertical direction, an end of the first pipe and an end of the second pipe open to a portion that is located above the partition member in the vertical direction, out of an inside of the pressure container, and the connector is located below in the vertical direction, more than the partition member.

8. The outdoor unit according to claim 7, wherein the fusible plug is located above in the vertical direction, more than the partition member.

9. The outdoor unit according to claim 1, wherein the pressure container is connected to an intake side of the compressor.

10. A refrigeration cycle device further comprising:

the outdoor unit according to claim 1; and an indoor unit.

* * * * *